United States Patent [19]

Yamaguchi

[11] 4,309,956

[45] Jan. 12, 1982

[54] SHOCK ABSORBING DEVICE FOR TUGBOAT

[75] Inventor: Noboru Yamaguchi, Yokohama, Japan

[73] Assignee: Bridgestone Tire Co., Ltd., Tokyo, Japan

[21] Appl. No.: 218,906

[22] Filed: Dec. 22, 1980

Related U.S. Application Data

[63] Continuation of Ser. No. 971,598, Dec. 20, 1978, abandoned.

[30] Foreign Application Priority Data

Jan. 23, 1978 [JP] Japan ..... 53-6017

[51] Int. Cl.[3] ..... B63B 21/56

[52] U.S. Cl. ..... 114/249; 114/219

[58] Field of Search ..... 114/219, 220, 242, 230, 114/249, 250; 267/136, 138; 294/64 R

[56] References Cited

U.S. PATENT DOCUMENTS

| | | | |
|---|---|---|---|
| 2,910,264 | 10/1959 | Lindenberger | 294/64 R |
| 3,152,828 | 10/1964 | Lytle | 294/64 R |
| 3,322,091 | 5/1967 | Stanwick | 114/242 |
| 3,974,794 | 8/1976 | Kakitani et al. | 114/242 |

*Primary Examiner*—Trygve M. Blix
*Assistant Examiner*—Jesús D. Sotelo
*Attorney, Agent, or Firm*—Sughrue, Mion, Zinn, Macpeak and Seas

[57] ABSTRACT

A shock absorbing device for a tugboat is disclosed. This device comprises a main cushion member having a close-fitting contact end opposed to a broadside of a vessel and an auxiliary cushion member having a close-fitting contact end projected over the contact end of the main cushion member toward the broadside, which are secured to a face plate disposed on a deck end of the tugboat.

8 Claims, 5 Drawing Figures

SHOCK ABSORBING DEVICE FOR TUGBOAT

This is a continuation of application Ser. No. 971,598, filed Dec. 20, 1978, now abandoned.

This invention relates to a shock absorbing device for tugboats, and more particularly it relates to a shock absorbing device for tugboats which are used in navigating middle- and large-sized vessels such as tankers, passenger boats, barges and the like in harbors, gulfs, bays and so on.

Generally, when the middle- and large-sized vessels travel into mooring installations in the harbor, tugboats are often used in pushing or towing the vessel for reasons of the installation or harbor, in addition to the self-travelling of the vessel. In order to push or tow the vessel with the tugboat, however, the tugboat should be first brought into contact with a broadside of the vessel. As a result, a shock produced at the time of contact cannot be avoided, so in order to prevent any damage to the broadside of the vessel, a shock absorbing device is provided on the tugboat or the like.

The present invention advantageously solves the aforementioned problem and provides a shock absorbing device for a tugboat comprising a main cushion member having a close-fitting contact end and an auxiliary cushion member having a close-fitting contact end projected over the contact end of the main cushion member toward the broadside of the vessel.

Figure 1:
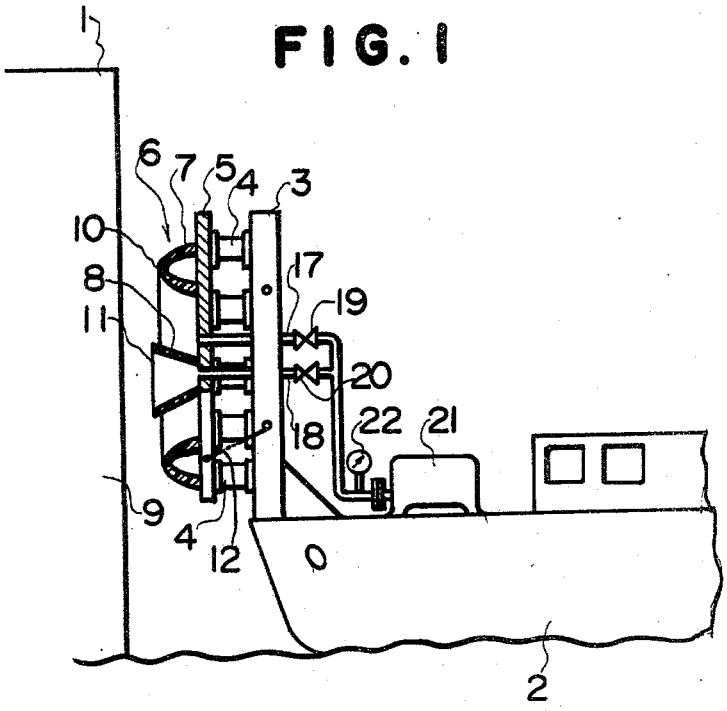
Figures 2A, 2B, 2C:
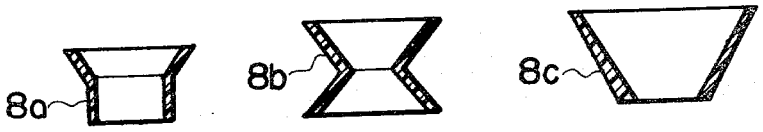
Figure 3:
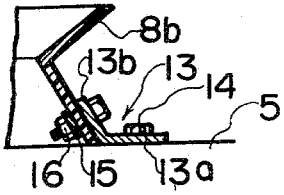

The invention will now be described in greater detail with reference to the accompanying drawings, wherein:

FIG. 1 is a side elevation illustrating a tugboat provided with an embodiment, partly shown in section, of the shock absorbing device according to the invention, as it is brought into contact with a broadside of a vessel;

FIGS. 2*a* to 2*c* are longitudinal sectional views of embodiments of the auxiliary cushion member to be used in the shock absorbing device according to the invention, respectively; and FIG. 3 is a partially sectional view illustrating an embodiment of securing the auxiliary cushion member to a face plate of the shock absorbing device according to the invention.

In FIG. 1 is shown an embodiment of the shock absorbing device for tugboat according to the invention, which is also able to act as a suction device for towing under suctorial force. Numeral 1 represents a vessel such as tanker or the like and numeral 2 represents a tugboat.

According to the invention, a supporting stand 3 is mounted upright on an end of the tugboat 2, for example, a bow thereof, so as to face the vessel 1. Then, a face plate 5 is arranged parallel to the stand 3 at a position slightly projected over the bow through a plurality of elastic members 4 connected to the stand 3.

If a shock absorbing device 6 as mentioned below has a satisfactory shock absorbing ability, the elastic members 4 may be omitted. In other words, the elastic members 4 are used in accordance with the shock absorbing ability of the shock absorbing device 6.

To a front of the face plate 5 facing the vessel 1 is installed the shock absorbing device 6 comprising a main cushion member 7 and an auxiliary cushion member 8, each of which is formed of rubber or rubber-like material.

The main cushion member 7 is composed of an annular and hollow resilient body formed of rubber or rubber-like material and is closed in section at its close-fitting contact end 10 opposed to a broadside 9 of the vessel 1 and terminates at bifurcated ends opposed to the face plate 5. Further, the main cushion member 7 has a thickness in section which is the smallest at the contact end 10 and becomes larger in a direction away from the contact end 10 toward the bifurcated ends, and is secured to the face plate 5 by a proper connecting means.

As shown in FIGS. 2*a* to 2*c*, the auxiliary cushion member 8 is constructed as a hollow resilient body 8*a* with a frustoconical part gradually diverging toward the broadside 9, and a cylindrical part. Alternately, the member 8 may take the form of a hollow resilient body 8*c* composed only of a frustoconical part gradually diverging toward the broadside 9. As shown in FIG. 2*b*, the member 8 can also be formed as a hollow resilient body 8*b* of double frustoconical shape. Further, the auxiliary cushion member 8 has an annular close-fitting contact end 11 projecting outwardly of the contact end 10 of the main cushion member 7 toward the broadside 9. The height of the auxiliary cushion member is 1.1–1.7 times higher than that of the main cushion member 7 as measured from the face plate 5. If the height of the auxiliary cushion member 8 is beyond the above defined range, the effect of the auxiliary cushion member as mentioned below cannot be achieved.

Moreover, it is preferable that the thickness section of the auxiliary cushion member 8 is the smallest at the contact end 11 and becomes larger in a direction away from the contact end 11 toward the other end thereof as in the case of the main cushion member 7, whereby the shock produced at the time of contact can be more mitigated by the initial deformation of the auxiliary cushion member. The auxiliary cushion member 8 is also secured to the face plate 5 by a proper connecting means.

Furthermore, the face plate 5 is suspended from the stand 3 by means of a chain 12 so as to prevent the hanging down of the face plate 5 and develop the performance of the shock absorbing device 6 sufficiently.

Although the stand 3 is disposed upright on the bow of the tugboat 2 in the embodiment of FIG. 1, it is preferable to conform the stand 3 to the shape of the broadside of various vessels, by rendering it to be rotatable along its longitudinal axis and rockable along its transverse axis.

The auxiliary cushion member 8 is arranged inside the main cushion member 7 in the embodiment of FIG. 1, but may be arranged outside of the main cushion member 7. Further, several auxiliary cushion members 8 may be used, if necessary.

The shock absorbing device according to the invention has the structure as mentioned above and may act as a suction device in the towing of a vessel under suctorial force. To this end, the main cushion member 7 and the auxiliary cushion member 8 are both airtightly secured to the face plate 5.

In FIG. 3 is shown an embodiment of airtightly securing the auxiliary cushion member to the face plate. In this case, an annular flat portion 13*a* of a fitting member 13 is secured to the face plate 5 through a sealing material (not shown) by means of bolts 14, while an end portion of the auxiliary cushion member 8*b* as shown in FIG. 2*b* is fitted in a tapered cylindrical portion 13*b* of the fitting member 13 and the fitted part is fastened by means of bolts and nuts 16 through an annular strapped washer 15. Similarly, such airtight securing can be applied to auxiliary cushion members 8 of other shapes, as well as to the main cushion member 7. In any case, a cloth or other reinforcing material may be embedded in the bolt fastened part of each cushion member to improve the durability of that part.

Then, the inner spaces of the main cushion member 7 and the auxiliary cushion member 8 are connected to a vacuum pump 21 through pipes 17, 18 and valves 19, 20, respectively.

In FIG. 1, numeral 122 represents a vacuum gauge arranged near an intake port of the vacuum pump 21.

The operation of the shock absorbing device according to the invention will be described below.

If it is intended to push the vessel 1 with the tugboat 2, the contact end 11 of the auxiliary cushion member 8 is first brought into contact with the broadside 9 of the vessel 1, whereby a part of an impact energy is absorbed by the auxiliary cushion member 8.

If the thickness in section of the auxiliary cushion member 8 is the smallest at the contact end 11 as mentioned above, the deflection of the contact end 11 becomes large at an initial contact stage, while the shock given to the contact end 11 becomes small. Then, the absorption quantity of the impact energy gradually increases with the advance of deflection toward the thickened part of the auxiliary cushion member 8.

When the contact end 11 of the auxiliary cushion member 8 deflects to a position corresponding to the contact end 10 of the main cushion member 7, the contact end 10 of the main cushion member 7 is also brought into contact with the broadside 9 of the vessel 1.

Since the thickness in section of the main cushion member 7 is the smallest at its contact end 10, the shock imparted to the contact end 10 is also considerably mitigated in addition to the partial absorption of the impact energy by the auxiliary cushion member 8. As a result, no excessive shock is imparted to the broadside 9, or the shock absorbing device 6 and the like.

The remainder of the impact energy is completely absorbed by the main and auxiliary cushion members 7, 8 with the increase of the deflection toward the thickened part.

Moreover, it is a matter of course that the elastic member 4 contributes to absorb the impact energy when all of the energy cannot be absorbed only by the deflection of the main and auxiliary cushion members 7, 8.

After the completion of the contact, the tugboat 2 is advanced to push the vessel 1 into a given position.

If it is intended to use the shock absorbing device according to the invention as a suction device for towing under suctorial force, after the tugboat 2 is brought into contact with the vessel 1 as described above, the main and auxiliary cushion members 7, 8 may be used as suction cups.

That is, the vacuum pump 21 is first actuated and the valve 20 is opened, whereby the auxiliary cushion member 8 is secured to the broadside 9 by suction. Since the auxiliary cushion member 8 has a frustoconical shape diverting toward the broadside 9 as shown in FIG. 2 it can easily be secured by suction to the broadside 9 with the rising degree of vacuum in the inner space of the auxiliary cushion member 8. If the thickness in section of the contact end 11 is the smallest, the sealability of the auxiliary cushion member 8 against the broadside 9 is more improved owing to its flexibility and hence the easy and sure suction contact can be achieved.

As the degree of vacuum in the inner space of the auxiliary cushion member 8 is further raised, the distance between the contact end 10 of the main cushion member 7 and the broadside 9 of the vessel 1 is shortened and finally becomes zero. After the vacuum degree in the auxiliary cushion member 8 is read out by the vacuum gauge 22 to confirm the sufficient suction contact between the auxiliary cushion member 8 and the broadside 9, the valve 20 is closed. Then, the valve 19 is opened and the inner space of the main cushion member 7 is evacuated to a given degree of vacuum, whereby the main cushion member 7 is secured by suction to the broadside 9.

Moreover, airtightness between the main cushion member 7 and the broadside 9 is sufficiently maintained by the action of the auxiliary cushion member 8, so that the suction contact of the main cushion member 7 to the broadside 9 can also be achieved easily and surely.

Such a suction state is always maintained at a constant by continuing the actuation of the vacuum pump 21 with the opening of the valve 19 in the towing of the vessel by suctorial force.

As mentioned above, the invention makes it possible to tow the vessel by suctorial force by the synergistic effect of the main cushion member with the auxiliary cushion member in the shock absorbing device provided on the tugboat. That is, when the shock absorbing device is composed only of the main cushion member, it is very difficult to secure the main cushion member to the broadside by suction because the inner space of the main cushion member is large and the rising of the degree of vacuum by suction is slow. On the other hand, when the auxiliary cushion member is used together with the main cushion member, even if the broadside of the vessel is somewhat curved or is irregular, the auxiliary cushion member is first brought into contact with the broadside because the auxiliary cushion member is arranged outwardly of the main cushion member toward the broadside. Furthermore, the inner space of the auxiliary cushion member is a good deal smaller than that of the main cushion member, so that the rising of the degree of vacuum by suction becomes faster and consequently the contact end of the auxiliary cushion member rapidly and surely adheres to the broadside. With the further rising of degree of vacuum, the contact end of the auxiliary cushion member is deflected such that the contact end of the main cushion member is finally brought into contact with the broadside. As a result, the main cushion member is surely secured to the broadside by suction even if the broadside is somewhat curved or is irregular.

The invention will now be described with reference to an example.

The shock absorbing device 6 as shown in FIG. 1 was constructed with the main cushion member 7 having a central diameter of 3,000 mm and the auxiliary cushion member 8 having a diameter at its contact end of 1,800 mm and a diameter at its other end of 1,300 mm, and the height of the auxiliary cushion member 8 is 1.5 times higher than that of the main cushion member 7 as measured from the face plate 5. When such a shock absorbing device is used to tow the vessel under a vacii, of 620 mmHg, the towing ability was about 60 tons, so that this device had sufficiently been put to practical use.

According to the invention, the shock absorbing device can be used to tow the vessel under suctorial force without developing its shock absorbing performance. In this case, the vacuum pump 21 is actuated when the contact end 11 of the auxiliary cushion member 8 is brought into contact with the broadside 9 of the vessel 1 and then the valve 20 is opened to adhere the auxiliary cushion member 8 to the broadside 9 and at the same time the broadside 9 is brought into contact with contact end 10 of the main cushion member 7 by the thus produced suctorial force.

When the vessel to be towed is small and the towing time is short, the towing can be carried out only by contacting the shock absorbing device to the broadside 9 from its front like the conventionally well-known suction board.

Moreover, the function of the shock absorbing device as a suction device can be developed during the pushing of the vessel so as to effectively prevent the separation of the vessel 1 from the tugboat 2.

Although several embodiments of the invention have been shown and described, it will be obvious that other adaptations and modifications can be made without departing from the scope of the invention. For instance, the close-fitting contact end of each cushion member may be made in forms other than the annular form, or, it is possible to automate the vacuum control by using an electromagnetic valve for the valve in the vacuum system.

According to the invention, the impact energy produced at the time of contact is substantially completely absorbed by the synergistic effect of the main cushion member and the auxiliary cushion member, so that the application of excessive shock to the broadside of the vessel is prevented by the shock absorbing device and as a result, the durability of each part can be further improved.

What is claimed is:

1. In a shock absorbing device for a tugboat used in the navigation of vessels wherein a main cushion member and at least one auxiliary cushion member arranged radially inwardly of said main cushion member are secured to a front of a face plate disposed on a deck end of said tugboat, and wherein the area located between the main cushion member and the auxiliary cushion member and the area enclosed by the auxiliary cushion member are connected through respective suction conduits to a vacuum pump, the improvement comprising: said auxiliary cushion member being provided with a close-fitting contact end facing the broadside of a vessel, said close-fitting contact end being arranged axially outwardly of a close-fitting contact end of said main cushion member in the direction of said broadside, said main cushion member being composed of an annular and hollow resilient body formed of rubber or rubber-like material, said main cushion member being closed in cross-section at said contact end and terminating in bifurcated ends in contact with said face plate, said main cushion member having a thickness in cross-section which is smallest at said contact end, and which becomes larger in the direction away from said contact end toward said bifurcated ends.

2. A shock absorbing device as claimed in claim 1, wherein the axial length of said auxiliary cushion member is 1.1 to 1.7 times higher than that of said main cushion member as measured from said face plate.

3. A shock absorbing device as claimed in claim 1, wherein said auxiliary cushion member is a hollow resilient body composed of a frustoconical shaped part gradually diverging toward said broadside, and a cylindrical part.

4. A shock absorbing device as claimed in claim 1, wherein said auxiliary cushion member is a hollow resilient body composed of a frustoconical shaped part gradually diverging toward said broadside, and an inverted frustoconical shaped part gradually diverging toward said face plate.

5. A shock absorbing device as claimed in claim 1, wherein said auxiliary cushion member is a hollow resilient body composed only of a frusto-conical shaped part gradually diverging toward said broadside.

6. A shock absorbing device as claimed in claim 1, wherein said auxiliary cushion member has a thickness in section which is smallest at said contact end and becomes larger in a direction away from said contact end toward its other end.

7. A shock absorbing device according to claim 1, further comprising a stand for supporting said face plate, said stand being connected to said face plate by means of elastic members.

8. A shock absorbing device according to claim 1, further comprising valve means for selectively connecting said vacuum pump to said main and auxiliary cushion members, respectively.

* * * * *